US008689753B2

(12) United States Patent
Villemure

(10) Patent No.: US 8,689,753 B2
(45) Date of Patent: Apr. 8, 2014

(54) LOCKING MECHANISM FOR VARIABLE ACTUATION USING A SHUTTLE PIN AND RETURN SPRING

(75) Inventor: Jeff Villemure, Eastpointe, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/703,254

(22) PCT Filed: Jun. 10, 2011

(86) PCT No.: PCT/US2011/039933

§ 371 (c)(1), (2), (4) Date: Jan. 21, 2013

(87) PCT Pub. No.: WO2011/156684

PCT Pub. Date: Dec. 15, 2011

(65) Prior Publication Data

US 2013/0104821 A1 May 2, 2013

Related U.S. Application Data

(60) Provisional application No. 61/353,958, filed on Jun. 11, 2010.

(51) Int. Cl.
*F01L 1/18* (2006.01)
*F01L 1/053* (2006.01)

(52) U.S. Cl.
CPC .. *F01L 1/18* (2013.01); *F01L 1/185* (2013.01); *F01L 1/053* (2013.01)
USPC ..... 123/90.39; 123/90.44; 74/559; 74/569

(58) Field of Classification Search
USPC ..... 123/90.39, 90.44; 74/559, 567, 569
See application file for complete search history.

(56) References Cited

U.S. PATENT DOCUMENTS

| | | | | |
|---|---|---|---|---|
| 6,314,928 | B1 | 11/2001 | Baraszu | |
| 6,923,151 | B2 | 8/2005 | Kreuter | |
| 7,730,861 | B2 * | 6/2010 | Ng | 123/90.39 |
| 2006/0157011 | A1 | 7/2006 | Proschko et al. | |
| 2006/0260579 | A1 | 11/2006 | Proschko et al. | |
| 2008/0149059 | A1 | 6/2008 | Murphy | |

FOREIGN PATENT DOCUMENTS

DE 10 2006 046 573 A1 4/2008

* cited by examiner

*Primary Examiner* — Ching Chang
(74) *Attorney, Agent, or Firm* — Lucas & Mercanti, LLP

(57) ABSTRACT

The roller finger follower employs two independent lost motion arms and a coupling device that locks both arms. A coupling element allows for changing from locked to unlocked mode. Components of the coupling element include a shuttle pin with a head, a shank and a cutout on which a rod is positioned, a coil spring which surrounds the outside diameter of the shuttle pin shank, and an end cap. By positioning the spring on the shuttle pin shank, a large spring diameter and short spring height can be used which allows for compact packaging. Also, a low spring rate is required.

8 Claims, 7 Drawing Sheets

LOCKING MECHANISM FOR VARIABLE ACTUATION USING A SHUTTLE PIN AND RETURN SPRING

CROSS-REFERENCE TO RELATED APPLICATIONS

This application is a 371 of PCT/US2011/039933 filed Jun. 10, 2011, which in turn claims the priority of U.S. 61/353,958 filed Jun. 11, 1010, the priority of both applications is hereby claimed and both applications are incorporated by reference herein.

FIELD OF INVENTION

The present invention relates to internal combustion engines and more particularly to switchable roller finger followers used in overhead cam engines where the finger followers can be deactivated in order to deactivate an intake or an exhaust valve.

BACKGROUND OF THE INVENTION

Internal combustion engines typically utilize one of several methods and/or devices to vary valve lift profiles, including roller finger followers.

Switchable roller finger followers are known, see, for example, U.S. Pat. No. 7,174,869 and DE 10 2006 046 573 A1. Such finger followers have an outer lever pivotably mounted outside an inner lever and a roller rotatably mounted on a transverse axle in a slot in the inner lever. The top surface of the outer lever acts as a contact surface for a high lift cam and the top surface of the roller acts as a contact surface for a low lift cam. A coupling element, which typically includes shuttle pin and a coil spring, is mounted at one end of the finger and oil from an oil source is used to activate the coupling element. When the coupling element is activated, it locks the outer lever to the inner lever and requires the follower to follow both the high lift cam and the low lift cam. When the coupling element is deactivated, the outer lever is free to pivot and, under the aid of a torsion spring, the outer lever pivots freely in conjunction with the high lift cam. This movement by the outer lever is conventionally referred to as the lost motion stroke.

Conventionally, the coil spring of the coupling element is mounted inside of, or in line with, the shuttle pin. However, packaging a coil spring in the housing of the finger follower that has a proper rate and diameter between the shuttle pin and the roller is very challenging.

SUMMARY OF THE INVENTION

The present invention is directed to a switchable roller finger follower where the finger follower can be deactivated in order to disengage an intake valve or an exhaust valve of an internal combustion engine which utilizes a relatively small envelope space.

Specifically, the present invention is directed to a coupling element that aids in ensuring the positioning of the finger follower between a locked mode or an unlocked mode. In general, the coupling element includes a coil spring which is packaged around the outer diameter of a shuttle pin. The shuttle pin has a head on one end and a cutout at the other end in which a rod is positioned traversely. The outer arms of the finger follower can be either in a locked or unlocked position depending on whether the coil spring that surrounds the shuttle pin is compressed or in a relaxed state. When oil is supplied to the finger follower the finger follower moves into the locked position. Here, the oil causes a pressure build-up. The pressure build-up in turn forces the coil spring to compress and the coupling element to move longitudinally toward the outer arms. The outer arms rest on the rod and become locked in position. When the oil pressure is released, the coupling element move longitudinally away from the outer arms and the outer arms are in an unlocked position.

The present invention ensures: (1) that the locking mechanism is packaged within other functional features of the finger follower; (2) that the locking mechanism does not add significant width or mass to the finger follower; (3) that both of the outer arms are capable of locking and unlocking simultaneously; and (4) that the locking mechanism can be activated by oil pressure and deactivated automatically or vice versa depending on the requirements of the application.

Broadly, the present invention can be defined as a switchable finger follower for a valve train of an internal combustion engine. The switchable finger follower has a lever having a valve stem support at a first end of the lever and a lash adjuster contact surface at a second end of the lever and a slot extending through the lever at the first end. A roller is mounted on a transverse axle in the slot. The switchable finger follower also has two separate, longitudinally extending outer arms. The first end of each of the arms is pivotally mounted at the first end of the lever and the other end of each of the arms extends toward the second end of the lever. Each of the arms moves between a down, unlocked position and a base, locked position. The switchable finger follower has spring means for restoring the arms to the base position. Moreover, the switchable finger follower has a coupling element mounted in a blind bore in the second end of the lever for engagement with a locking surface on a bottom wall at the second end of each of the arms to lock and unlock the arms. The coupling element comprises a shuttle pin, a spring that surrounds the shuttle pin, a rod positioned transversely on the shuttle pin, and an end cap which seals the blind bore.

In one embodiment, the spring is a coil spring.

In a further embodiment, the shuttle pin has a head at one end, closest to the end cap and a cutout at the other end in which the rod is positioned.

In another embodiment, the head has a plurality of cutouts, which can be equally distributed.

In yet another embodiment, the spring is positioned on a shank of the shuttle pin, between the head and the cutout.

In a yet a further embodiment, the shank has a tapered section. The tapered section is located on a side of the shank opposite the cutout, and extends from the cutout to the head of the shuttle pin.

BRIEF DESCRIPTION OF THE DRAWINGS

The present invention will be further understood and appreciated by reading the following description in conjunction with the accompanying drawings, in which.

DETAILED DESCRIPTION OF THE INVENTION

Figure 1:
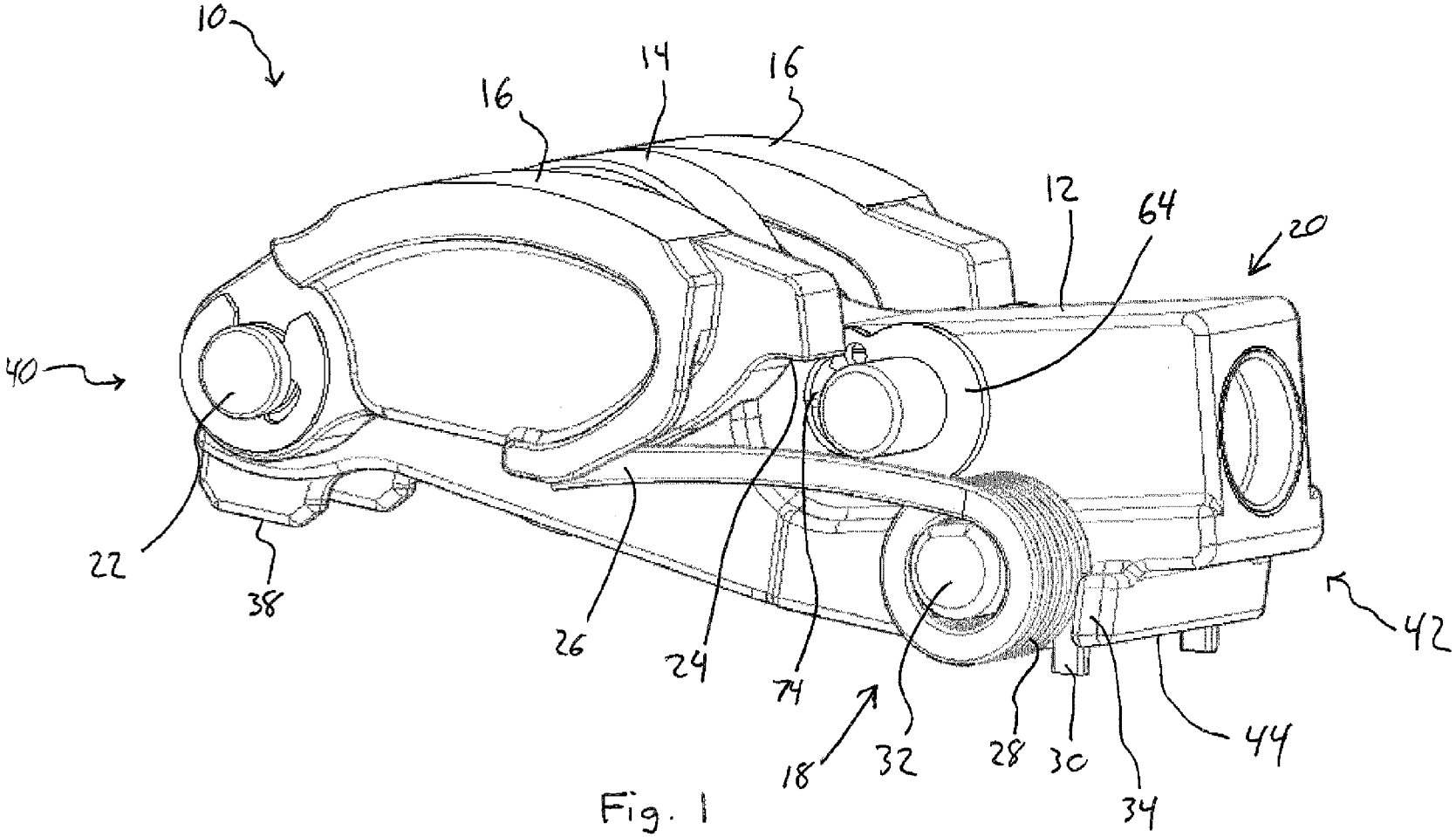
FIG. 1 is a perspective view of the finger follower of the invention.
Figure 4:
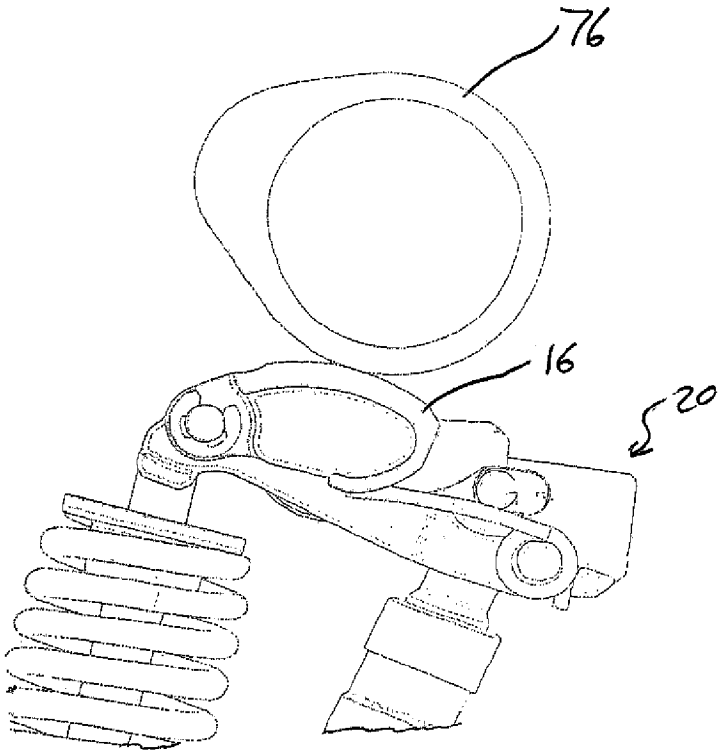
FIG. 4 is a side view of the finger follower in the locked mode.
Figure 3:
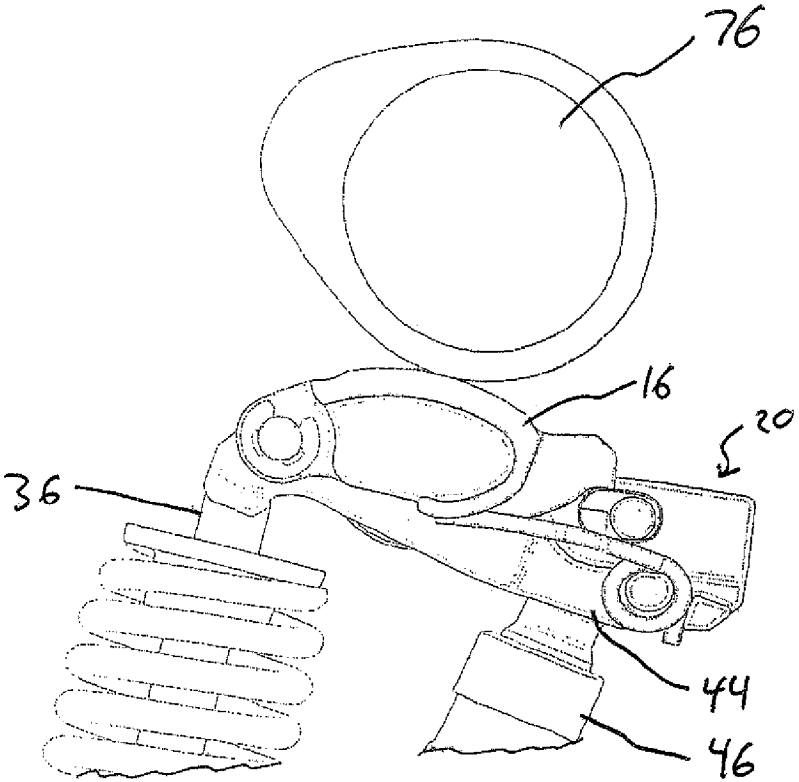
FIG. 3 is a side view of the finger follower in the unlocked mode.
Figure 5:
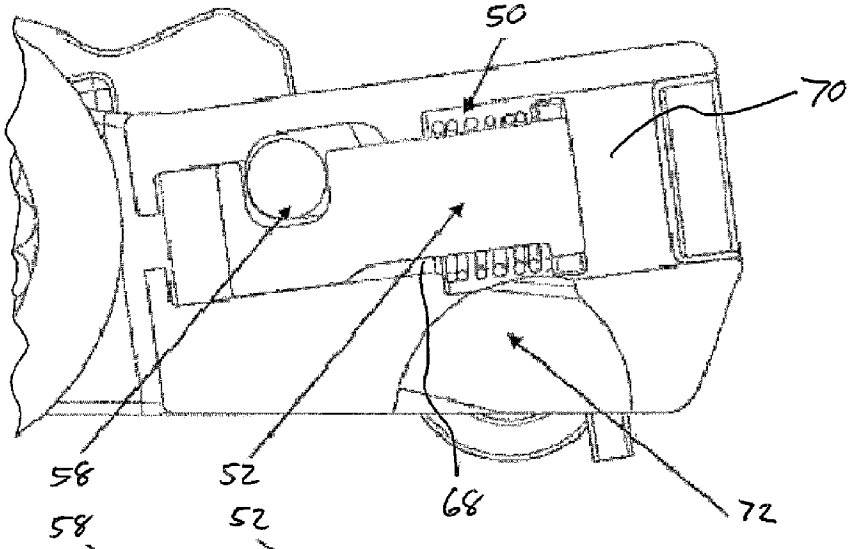
FIG. 5 is a cutaway side view of the finger follower in the locked mode.
Figure 6:
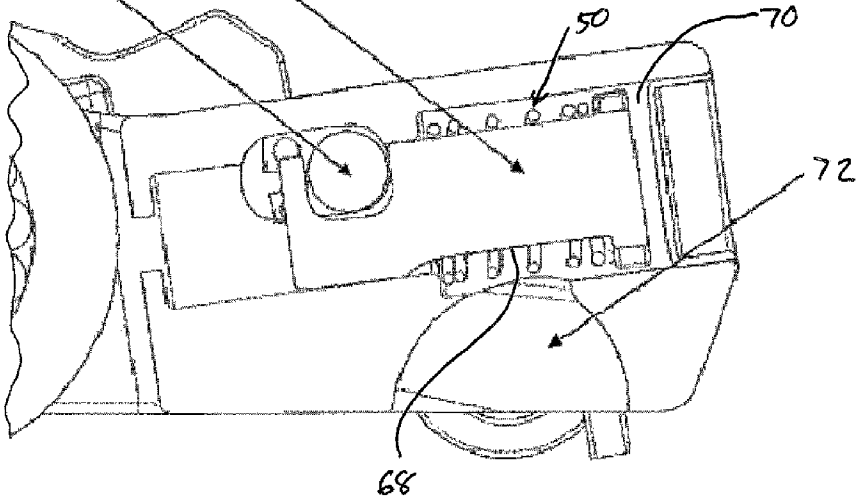
FIG. 6 is a cutaway side view of the finger follower in the unlocked mode.

FIG. 1 illustrates switchable finger follower 10 having inner lever 12 in which roller 14 is mounted and outer arms 16 which are acted on by torsion spring 18. Coupling element 20 can lock arms 16 in a base position, as illustrated in FIGS. 4 and 5, or can allow arms 16 to freely pivot in an unlocked mode between the locked mode base position, as shown in FIGS. 3 and 6, and a down position, as illustrated in FIG. 3A.

Rod 22 allows for the pivoting action of arms 16, which have locking surface 24. Torsion spring 18 has long leg 26, coils 28 and short leg 30. Long leg 26 acts on locking surface 24 of arm 16. Post 32 is used for mounting torsion spring 18 and stop 34 acts as a stop for short leg 30.

Finger follower 10 operates on valve stem 36 (see, FIG. 3) and has valve stem support 38 located at valve stem end 40. Lash adjuster end 42 of finger follower 10, has lash adjuster contact surface 44 which is operated on by lash adjuster 46 (see, FIG. 3).

Figure 2:
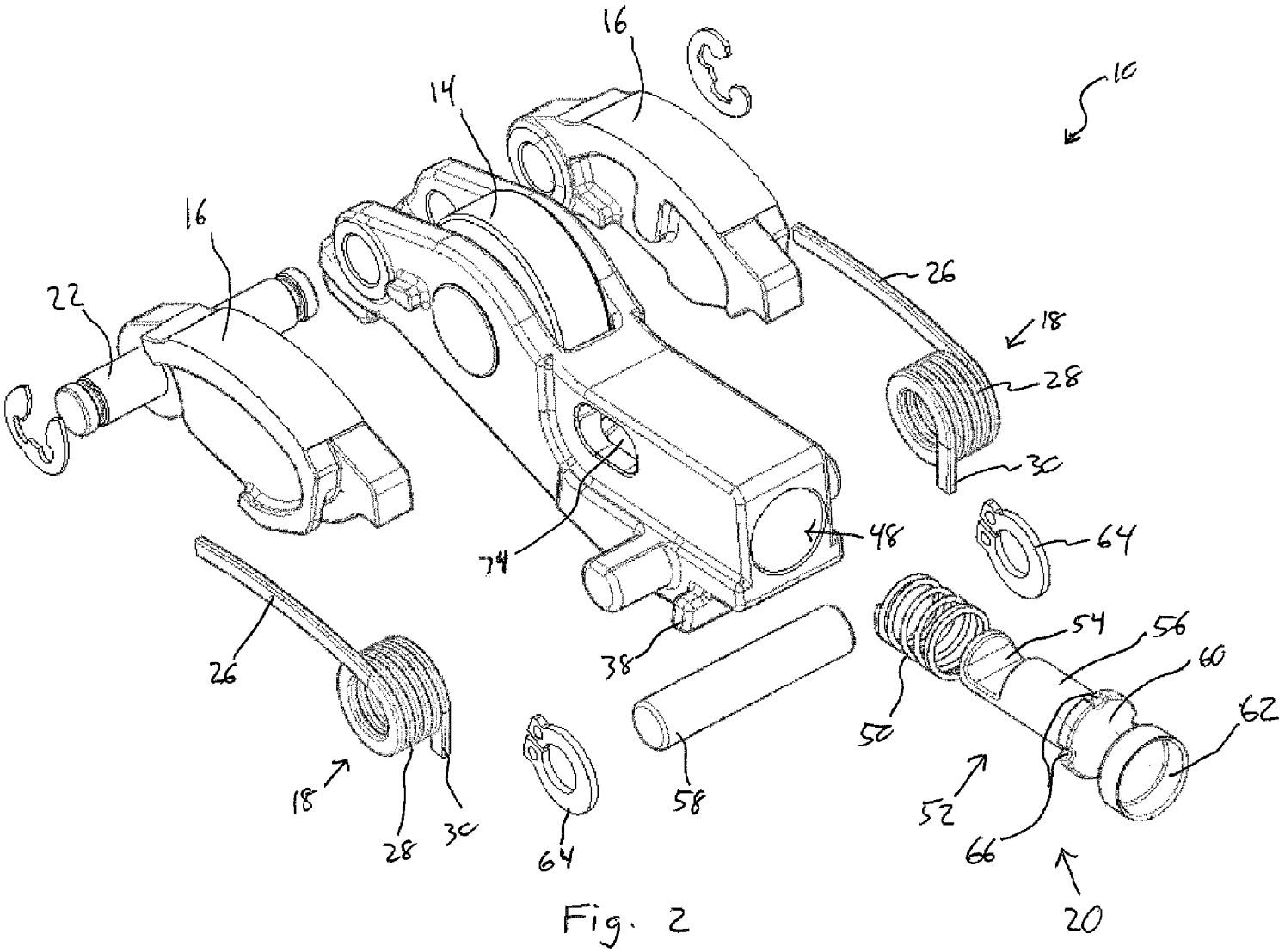
FIG. 2 is an exploded view of the finger follower of the invention.
Figure 2A:
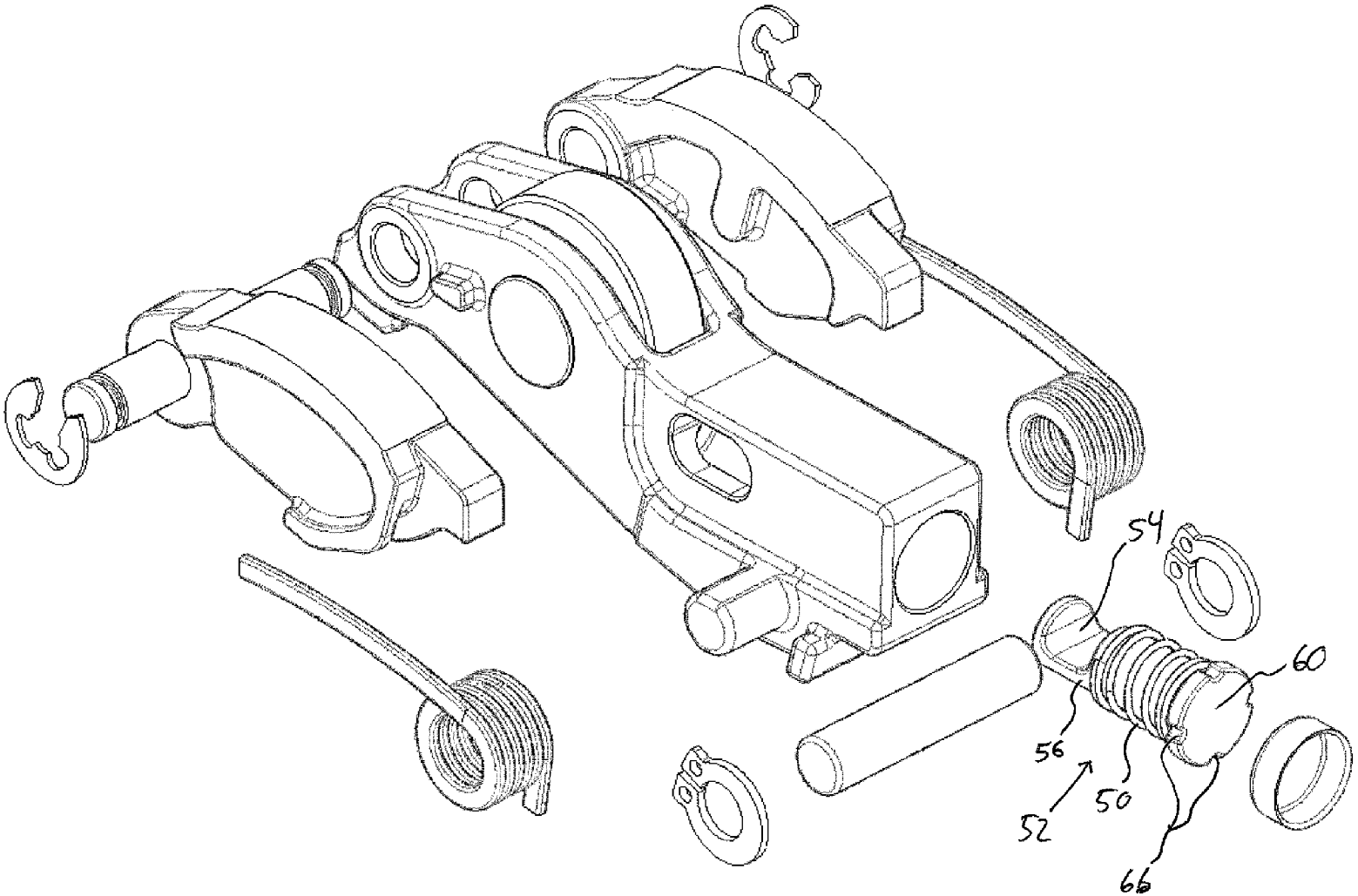
FIG. 2A is an exploded view of the finger follower of the invention.

FIGS. 2 and 2*a* illustrate exploded views of finger follower 10. Coupling element 20 comprises blind bore 48, coil spring 50, shuttle pin 52, which has a shank 56 with cutout 54 for housing rod 58 and a head 60 against which coil spring 50 presses, and end cap 62 which closes blind bore 48. Spring clips 64 are press fitted onto the ends of rod 58 to hold rod 58 in a coupling element 20. Head 60 has a plurality of cutouts 66, allowing oil to pass head 60. In addition to cutout 54, shank 56 has tapered section 68 (see, FIGS. 5 and 6) which is located on the side of shank 56 that is opposite where cutout 54 is formed. Thus, cutout 54 and tapered section 68 are 180 degrees apart from each other on shank 56.

Figure 7:
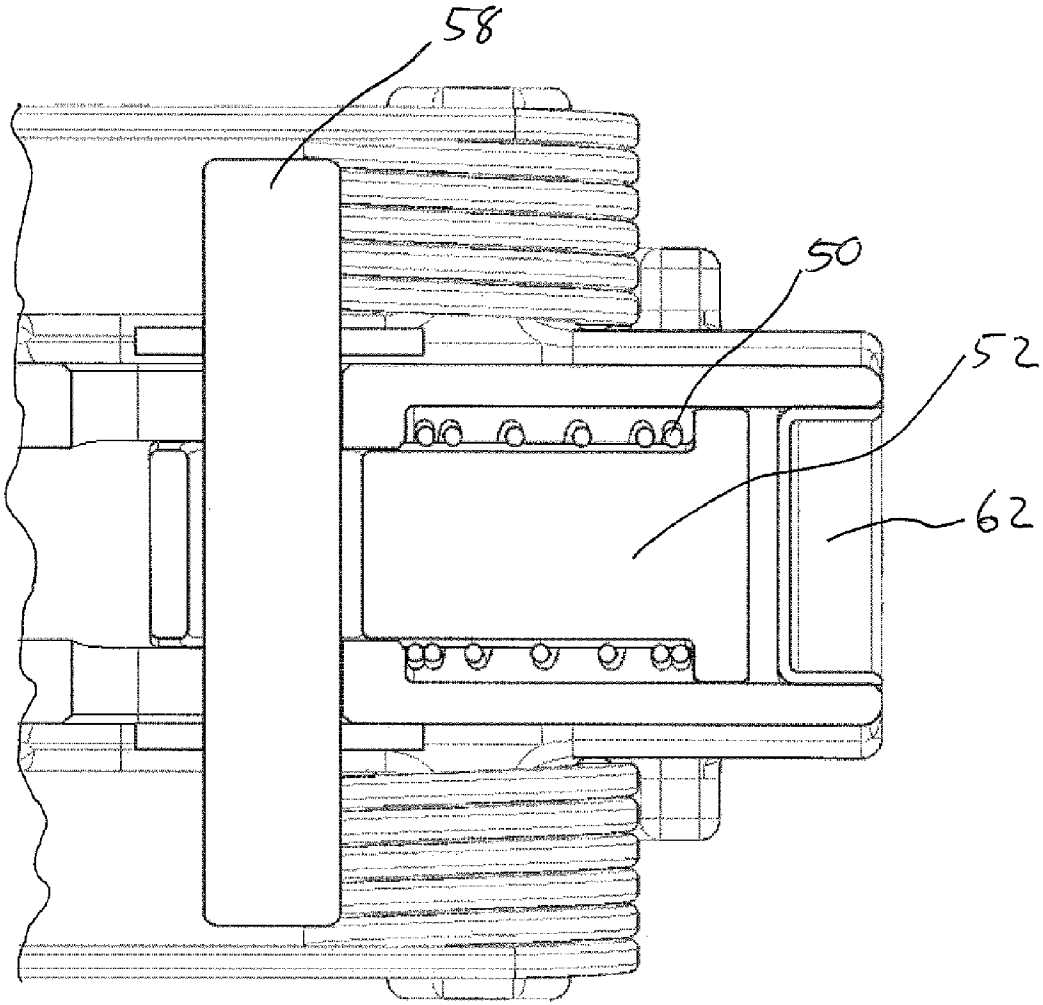
FIG. 7 is a cutaway top view of the finger follower.

As shown in FIGS. 2A and 7, the outside diameter of shank 56 of shuttle pin 52 is surrounded by coil spring 50.

Oil chamber 70 (see also, FIGS. 5 and 6) is formed between inside wall of end cap 58 and the head 60 of shuttle pin 52. Oil pressure is provided through conventional oil pressure supply system 72 to oil chamber 70 through lash adjuster 46 and an inlet in lash adjuster contact surface 44. Oil from lash adjuster 46 enters oil chamber 70 through the inlet and exits through spray hole (not shown).

As illustrated in FIGS. 3, 3A, 3B and 4, cam 76 operates on arms 16 and on roller 14 to move arms 16 and finger follower 10 up and down.

In order to lock arms 16 in the base position, as illustrated in FIGS. 4 and 5, oil pressure is used on locking mechanism 20. Oil pressure is used to compress coil spring 50 and to move shuttle pin 52 towards arms 16 which in turn also moves rod 58 longitudinally so as to contact locking surface 24 on arm 16. Spring clip 64 ensures rod 58 is positioned in oblong hole 74. Oil escapes through a spray hole (not shown) when oil pressure is released from acting on locking mechanism 20.

As is illustrated in FIG. 3A, when rod 58 has been moved toward arm 16 and arm 16 is in the down position, arm 16 comes into contact with rod 58. Due to the force of torsion spring 18 on arm 16, rod 58 is moved in a longitudinal manner towards the lash adjuster end 42 of finger follower 10. This allows arm 16 to move past rod 58. Once arm 16 has moved past rod 58, the oil pressure provided to oil chamber 70 allows rod 58 to move in oblong hole 74 towards valve stem end 40 of finger follower 10, thus, allowing rod 58 to contact arm 16 as illustrated in FIG. 4.

Figure 3B:
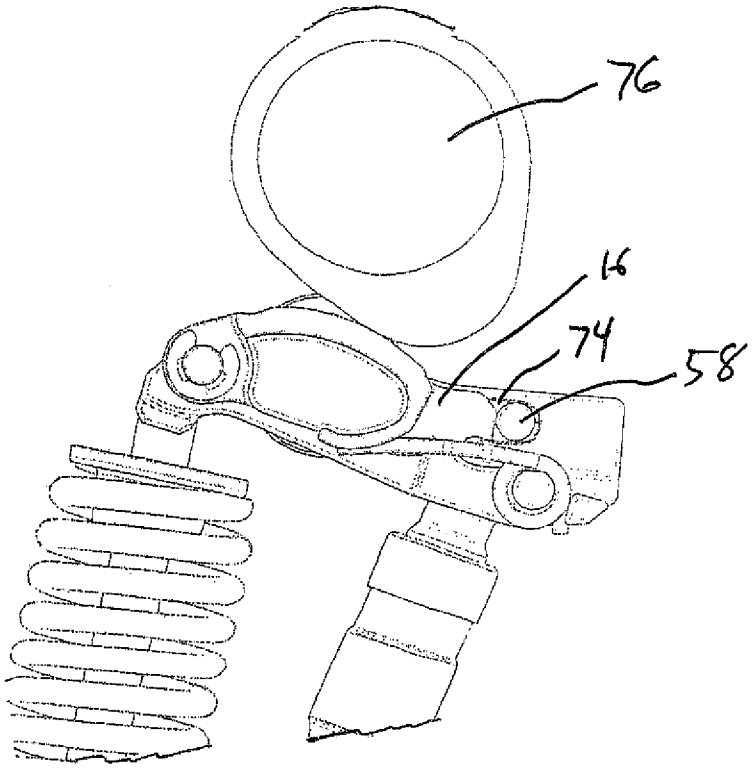
FIG. 3B is a side view illustrating the arms moving the rod longitudinally rearward.
Figure 3A:
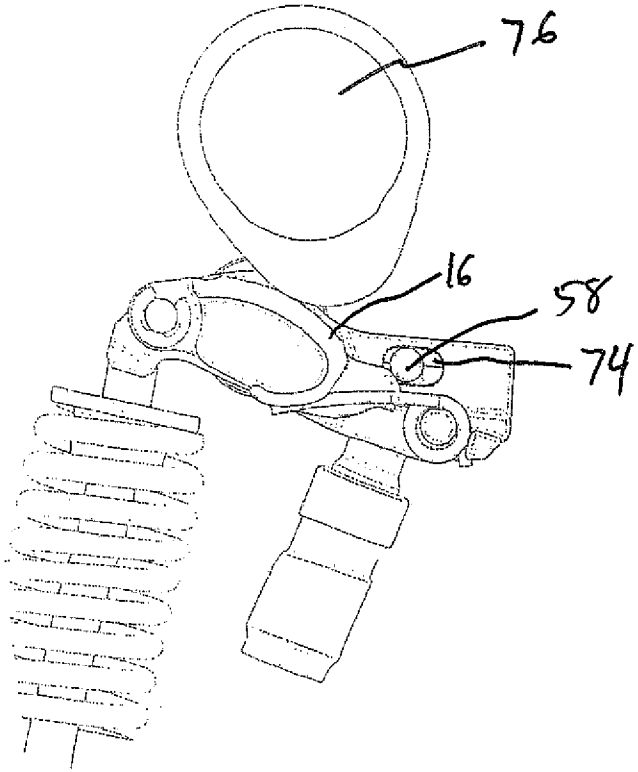
FIG. 3A is a side view illustrating the arms moving the rod longitudinally rearward.

As shown in FIGS. 3B and 6, when oil pressure is released from oil chamber 70, coil spring 50, shuttle pin 52 and rod 58 move towards lash adjuster end 42 of lever 12.

FIG. 5 shows a cross-sectional view of shuttle pin 52 and rod 58 in the loaded position. Coil spring 50, which surrounds the outside diameter of shuttle pin 52, is compressed.

FIG. 6 shows a cross-sectional view of shuttle pin 52 and rod 58 in the unloaded position. Coil spring 50, which surrounds the outside diameter of shuttle pin 52, is relaxed.

Packaging coil spring 50 on the outside diameter of shuttle pin 52 allows for a larger outside diameter and shorter spring height for compact packaging. By positioning coil spring 50 on the outside diameter of shuttle pin 52, the resulting spring rate is not as high as the spring rate(s) of a spring not positioned on the outside diameter of a shuttle pin.

FIG. 7 is a top view showing the packaging configuration of shuttle pin 52, coil spring 50, rod 58 and end cap 62 in finger follower 10.

The present invention has been described with reference to a preferred embodiment. It should be understood that the scope of the present invention is defined by the claims and is not intended to be limited to the specific embodiment disclosed herein.

REFERENCE CHARACTERS

10 Switchable Finger Follower
12 Inner Lever
14 Roller
16 Outer Arm
18 Torsion Spring
20 Coupling Element
22 Rod
24 Locking Surface
26 Long Leg
28 Coils
30 Short Leg
32 Post
34 Stop
36 Valve Stem
38 Valve Stem Support
40 Valve Stem End
42 Lash Adjuster End
44 Lash Adjuster Contact Surface
46 Lash Adjuster
48 Blind Bore
50 Coil Spring
52 Shuttle Pin
54 Cutout
56 Shank
58 Rod
60 Head
62 End Cap
64 Spring Clip
66 Cutouts
68 Tapered Section
70 Oil Chamber
72 Oil Pressure Supply System
74 Oblong Hole

What is claimed:

1. A switchable finger follower for a valve train of an internal combustion engine, comprising:

a lever having a valve stem support at a first end of the lever and a lash adjuster contact surface at a second end of the lever and a slot extending through the lever at the first end;

a roller mounted on a transverse axle in the slot;

two separate, longitudinally extending outer arms, one end of each of the arms pivotally mounted at the first end of the lever and the other end of each of the arms extending towards the second end of the lever, each of the arms moving between a down, unlocked position and a base, locked position;

spring means for restoring the arms to the base position; and a coupling element mounted in a blind bore in the second end of the lever for engagement with a locking surface on a bottom wall at the second end of each of the arms to lock and unlock the arms, the coupling element comprising a shuttle pin, a spring that surrounds the shuttle pin, a rod positioned transversely on the shuttle pin and an end cap which seals the blind bore.

2. The switchable finger follower of claim 1, wherein the spring is a coil spring.

3. The switchable finger follower of claim 1, wherein the shuttle pin has a head at one end, closest to the end cap and a cutout at the other end in which the rod is positioned.

4. The switchable finger follower of claim 3, wherein the head has a plurality of cutouts.

5. The switchable finger follower of claim 4, wherein the cutouts are equally distributed.

6. The switchable finger follower of claim 5, wherein the Shank has a tapered section.

7. The switchable finger follower of claim 3, wherein the spring is positioned on a shank of the shuttle pin, between the head and the cutout.

8. The switchable finger follower of claim 7, wherein the tapered section is on a side of the shank opposite the cutout, and extends from the cutout to the head of the shuttle pin.

* * * * *